US008935946B1

(12) United States Patent
Petricio Yaksic

(10) Patent No.: US 8,935,946 B1
(45) Date of Patent: Jan. 20, 2015

(54) VARIABLE DIAMETER NOZZLE, JOINT AND ROD FORMING USING CAM ROLLERS

(76) Inventor: Davor Petricio Yaksic, Antofagasta (CL)

( * ) Notice: Subject to any disclaimer, the term of this patent is extended or adjusted under 35 U.S.C. 154(b) by 495 days.

(21) Appl. No.: 13/227,020

(22) Filed: Sep. 7, 2011

Related U.S. Application Data

(60) Provisional application No. 61/402,920, filed on Sep. 7, 2010.

(51) Int. Cl.
*B21B 21/00* (2006.01)
*B21C 37/16* (2006.01)
*B21B 23/00* (2006.01)

(52) U.S. Cl.
CPC ..... *B21C 37/16* (2013.01); *B21B 23/00* (2013.01)
USPC ..... 72/370.23; 72/115; 72/190; 72/252.5

(58) Field of Classification Search
CPC ..... B21B 13/20; B21B 13/18; B21B 17/14; B21B 23/00
USPC ..... 72/84, 115, 117, 118, 120, 121, 214, 72/220, 224, 367.1, 370.23, 370.24, 72/370.25, 399, 402, 190, 191, 192, 194, 72/252.5; 492/1
See application file for complete search history.

(56) References Cited

U.S. PATENT DOCUMENTS

| | | | | | |
|---|---|---|---|---|---|
| 709,958 | A * | 9/1902 | Beck | 72/191 |
| 2,029,552 | A * | 2/1936 | Barnhart | 72/194 |
| 2,342,917 | A * | 2/1944 | Brown | 72/194 |
| 3,842,635 | A * | 10/1974 | Bibighaus | 72/220 |
| 4,038,850 | A * | 8/1977 | Sakagami | 72/370.23 |
| 4,418,458 | A | 12/1983 | Hunter | |
| 4,541,655 | A | 9/1985 | Hunter | |
| 5,845,527 | A * | 12/1998 | Hoffmann et al. | 72/69 |
| 7,197,906 | B2 | 4/2007 | Tsuyuguchi et al. | |
| 7,316,142 | B2 * | 1/2008 | Lancaster | 72/121 |
| 7,690,237 | B2 | 4/2010 | Slack | |
| 2005/0144998 | A1 * | 7/2005 | Massee | 72/84 |

* cited by examiner

*Primary Examiner* — Teresa M Ekiert
(74) *Attorney, Agent, or Firm* — James Creighton Wray

(57) ABSTRACT

A radial dimension of a pipe is changed by applying contiguous pipe contacting surfaces of adjacent cam rollers. Pipe contacting surfaces uniformly vary in width of curvatures as distances change between a center of rotation of the cam rollers and the pipe contacting surfaces side walls of the cam rollers are shaped and adjacent. Bevel gear teeth on sloped side walls force all rollers to turn uniformly. Cylinders on a frame surrounding the pipe drive pistons, lever arms and cam rollers that move the pipe wall. Radial forces on the cam rollers hold sloped side walls adjacent, bevel gears engaged and pipe contacting surfaces contiguous. Smoothly deforming a pipe wall inward forms a nozzle sat an end, a restrictor, a pipe closure, a solid rod or a pipe joint. In a joint, outer and inner pipe walls are moved inward respectively beyond and within elastic limits, ensuring tightness.

20 Claims, 8 Drawing Sheets

CROSS SECTION AOD

CROSS SECTION OA

CROSS SECTION OB

CROSS SECTION OC

VARIABLE DIAMETER NOZZLE, JOINT AND ROD FORMING USING CAM ROLLERS

This application claims the benefit of U.S. Provisional Application No. 61/402,920, filed Sep. 7, 2010, which is hereby incorporated by reference in its entirety as if fully set forth herein.

BACKGROUND OF THE INVENTION

Summary of the Invention

To reduce a pipe's size and to form a joint, to form a nozzle or a solid bar, a steel pipe is centered in a heavy ring. Plural cylinders are radially pivoted on an outside of the ring. Plural roller cams are rotated on the axles. Levers radially extend from the cam rollers. Outer ends of the levers are connected with outer ends of the piston rods. Continuous cam roller surfaces are formed with increasing radii from the cam centers and sides of the roller cams are laterally tapered. The roller cams have decreasing widths and smaller radii on pipe contacting surfaces as the distance between the pipe contacting surfaces and the axles increases. Pipe contacting surfaces of the cam rollers remain close together as the pipe moves axially by driving the piston rods and levers to rotate the cam rollers. The result is a smoothly reduced pipe diameter. When the pipe is fixed, forced rotation of the cam rollers slightly moves the ring along the pipe. The cam rollers are formed with meshing gears on their sloped sides to ensure uniform rotation of all cam rollers upon inward force of the pistons.

The invention is usable as an emergency pipe throttle to stop the flow in case of a broken pipe.

The new machine is used to make conical pipes or bars, drawing the pipe or bar through a variable diameter nozzle.

The invention is useful to evenly press a solid hose clamp or to join a hose to a fitting.

In using the invention to make a permanent joint between two pipes, it may be necessary to enlarge the internal diameter of one end on each pipe in the factory, as it is with plastic pipes. Then to make a pipe joint on site, it is necessary to put one end of a pipe into an enlarged end of another pipe and to press the enlarged end inward to make a joint using the new machine.

Compressing a pipe wall inward forms a nozzle, joint or solid rod. Rotating cam rollers with curved pipe contacting surfaces on a surface of the pipe forces a wall of the pipe to move radially with outer surfaces of the cam rollers while turning the cam rollers.

Widths and radii of curvature of outer pipe contacting surfaces change concurrently with changing radial distances of the pipe contacting surfaces from centers of the cam rollers.

The pipe is surrounded with a rigid frame. Outer ends of cylinders are pivoted on the frame. Ends of pistons from the cylinders connect to lever arms to rotate the cam rollers. Axles are fixed on inner ends of the frame. The cam rollers are mounted on the axles. Applying hydraulic pressure in the cylinders forces the pistons inward, rotating the lever arms with the pistons, rotating the cam rollers with the lever arms and moving the pipe contacting surfaces inward on the pipe. A wall of the pipe is moved inward by the pipe contacting surfaces, reducing diameters of outer and inner surfaces of the pipe, and increasing thickness of a wall of the pipe.

Two lever arms are connected to each cam roller, one lever arm on either side of each cam roller. The axles are fixed in planes perpendicular to a longitudinal axis of the pipe. The cam rollers rotate in planes radiating from the longitudinal axis of the pipe.

The cam rollers have sloping side surfaces for maintaining contiguity of the pipe contacting surfaces while rotating the cam rollers. Meshing bevel gears on the sloping side surfaces of the cam rollers force uniform rotation of the cam rollers.

The pipe is fixed against movement while rotating the cam rollers and forcing the surface and a wall of the pipe to move radially, or the pipe moves axially in a direction of the cam rollers while rotating the cam rollers and forcing the surface and a wall of the pipe to move radially.

The nozzle, joint or solid rod former has a frame. Plural cylinders have ends connected to the frame. Pistons are mounted in the cylinders. Axles are connected to the frames and cam rollers are mounted on the axles. Lever arms are connected to the cam rollers and are connected to the pistons. The cam rollers have outer peripheral pipe contacting surfaces of varied distance from the axles. The pipe contacting surfaces have concave surfaces of varied radii of curvature. The radii of curvature decrease as the distance from the axles increases. The cam rollers have sloped side walls of decreasing width between the side walls as the distance from the axles increases. Increasing pressure in the cylinders moves the pistons which rotate the lever arms and the cam rollers, increases the distance of the pipe contacting surfaces from the axles, and decreases the radii of curvature of the pipe contacting surfaces and forces a wall of a pipe inward, decreasing diameters of inner and outer surfaces of the pipe and increasing wall thickness of the pipe.

A radial dimension of a pipe is changed by applying contiguous pipe contacting surfaces of adjacent cam rollers. The pipe contacting surfaces uniformly vary in width and radii of curvatures as distances change between a center of rotation of the cam rollers and the pipe contacting surfaces side walls of the cam rollers are shaped and adjacent. Bevel gear teeth on sloped side walls force all rollers to turn uniformly. Cylinders supported on a frame surrounding the pipe drive pistons, lever arms and cam rollers that move the pipe wall. Radial forces on the cam rollers hold the sloped side walls adjacent, the bevel gears engaged and the pipe contacting surfaces contiguous. Smoothly deforming a pipe wall inward forms a nozzle sat an end, a restrictor, a pipe closure, a solid rod or a pipe joint. In a joint, outer and inner pipe walls are moved inward respectively beyond and within elastic limits, ensuring tightness.

These and further and other objects and features of the invention are apparent in the disclosure, which includes the above and ongoing written specification, with the claims and the drawings.

DETAILED DESCRIPTION OF THE DRAWINGS

Figure 1:
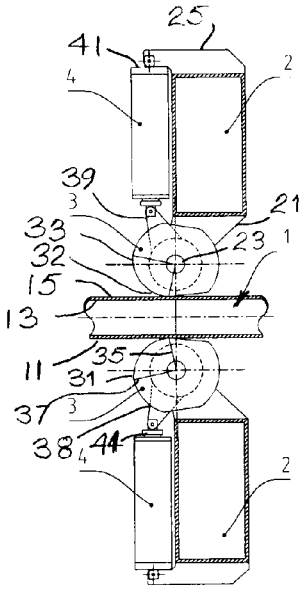
FIG. 1 is a cross sectional side view of the device used to reduce a section of a pipe or to transform a section of a pipe into a solid bar.

FIG. 1 is a cross sectional side view of the device used to reduce a section of a pipe or to transform a section of a pipe in a solid bar. FIG. 1 shows the pipe 1, the circular or annular box frame 2, eight cam rollers 3 and eight hydraulic cylinders 4. The cam rollers contact the pipe in the first step in the process.

As shown in FIG. 1, a pipe 1 has a standard wall thickness 11 between standard inner 13 and outer 15 diameters. A large, strong annular frame 2 surrounds the pipe 1. Plural, radial supports 21 extend inward from the frame. Plural axles 23 are mounted at the inward ends of the radial supports 21.

Plural roller cams 3 are mounted on the axles 23. The roller cams have peripheral concave cam roller surfaces 31 spaced from the axles 23 with uniformly increasing radial distances 32, 33 from the axles 23. The cam roller surfaces 31 have arcs that are continuously at greater distance from the axles 23 and that continuously have smaller surface radii to form the intended radius of the pipe at that position. The curved outer surfaces 31 of the cam rollers 3 form the curvature of the pipe 1 outer surface 15. Between points 35 and 37 on the cam rollers 3, the outer surfaces of the cam rollers have radii that reduce as the radial distances between the outer cam roller surface and the axle increase.

Cam roller levers 38 have central parts welded to the cam rollers and have outer ends 39 for pivotally connecting to piston rods. Ends 41 of cylinders 4 are pivoted on supports 25 extending laterally from outer portions of the annular frame 2. Piston rods 43 extend from cylinders 4 and are pivotally connected to outer ends 39 of the cam roller levers 38. As hydraulic pressure is supplied to the cylinders 4, extensions of the piston rod heads 44 cause lever arms 38 to turn the cam rollers 3.

Figure 2:
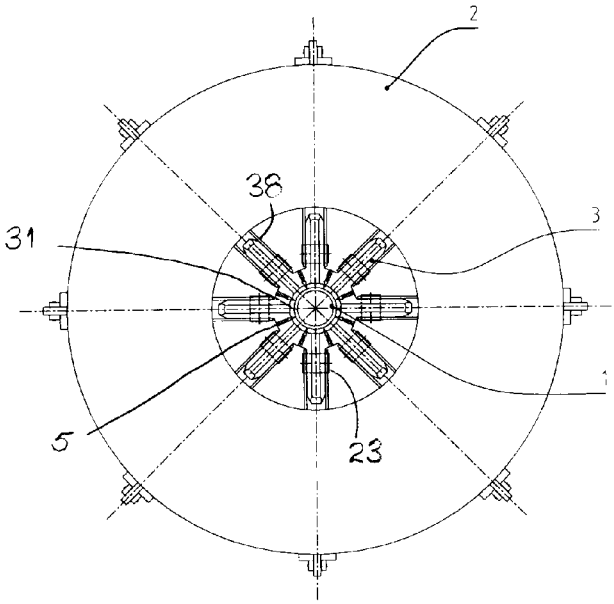
FIG. 2 is an end view of the device taken from a right side of FIG. 1.

FIG. 2 is an end view of the machine taken from a right side of FIG. 1 and showing the cam rollers 3 at points where the inwardly curved outer surfaces 31 of the cam rollers match the outer surface of the pipe 1 and before points 35 where the radial distances between the axles 23 and the cam roller surfaces increase and the cam roller outer surfaces 31 radii decrease to force the pipe wall 11 inward.

Figure 3:
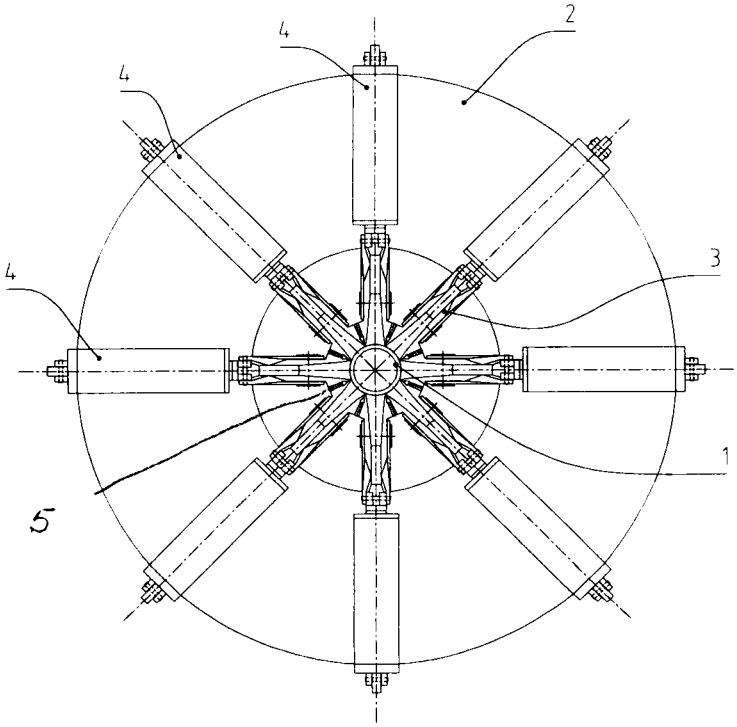
FIG. 3 shows an end view opposite to FIG. 2 taken from a left side of FIG. 1.

FIG. 3 shows an end view opposite to the end view shown in FIG. 2 and taken from the left side of FIG. 1. FIG. 3 shows the frame 2, the cylinders 4 and the cam rollers 3 from the left side of FIG. 1. The meshing teeth 5 on sloped sections of sides of the cam rollers 3 are shown in FIGS. 2 and 3.

Figure 4:
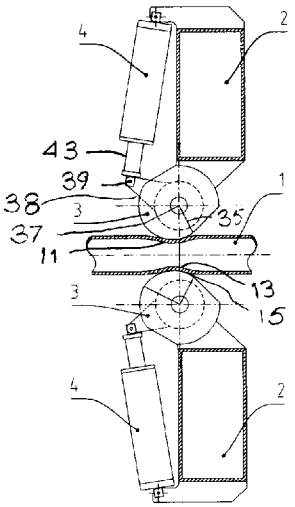
FIG. 4 shows how the hydraulic cylinders and cam rollers press the pipe inward, reducing the outer and inner pipe diameters and increasing wall thickness of the pipe.

FIG. 4 shows how the hydraulic cylinders 4, piston rods 43, lever arms 38 and cam rollers 3 press the pipe, reducing pipe 1 outer 15 and inner 13 diameters and increasing wall thickness 11. FIG. 4 is a view similar to FIG. 1 in which increased hydraulic pressure in cylinders 4 has caused the piston rods 43 to extend and drive the outer ends 39 of lever arms 38. The levers 38 cause the cam rollers 3 to turn uniformly, compressing the pipe wall 11 inward and reducing the outer 15 and inner 13 pipe diameters, while thickening the pipe wall 11.

Figure 5:
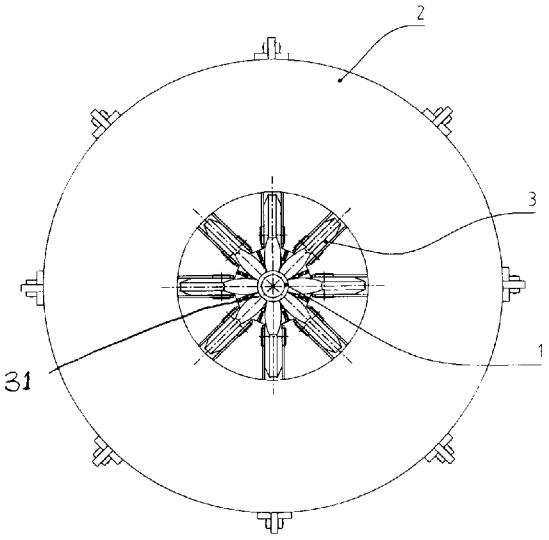
FIG. 5 is an end view of the device taken from the right side of FIG. 4.

FIG. 5 is an end view of the device taken from a right side of FIG. 4. FIG. 5 shows that the curved cam roller surfaces 31 remain adjacent to each other as the radii of the cam rollers increase and the widths and radii of the cam roller curved outer surfaces 31 decrease between angular points 35 and 37 on the cam rollers 3 as shown in FIGS. 1 and 4.

Figure 6:
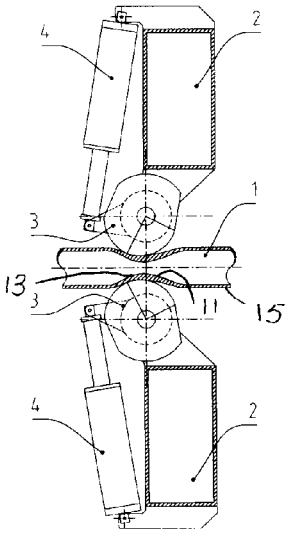
FIG. 6 shows how the hydraulic cylinders continue moving arms, rotating the cam rollers and pressing the pipe, and continue reducing the diameter and increasing wall thickness.

FIG. 6 shows how the hydraulic cylinders 4, pistons 43, lever arms 38 and cam rollers 3 continue pressing the pipe 1 inward, continue reducing the pipe inner and outer diameters 13, 15 and continue increasing the pipe wall thickness 11.

Figure 7:
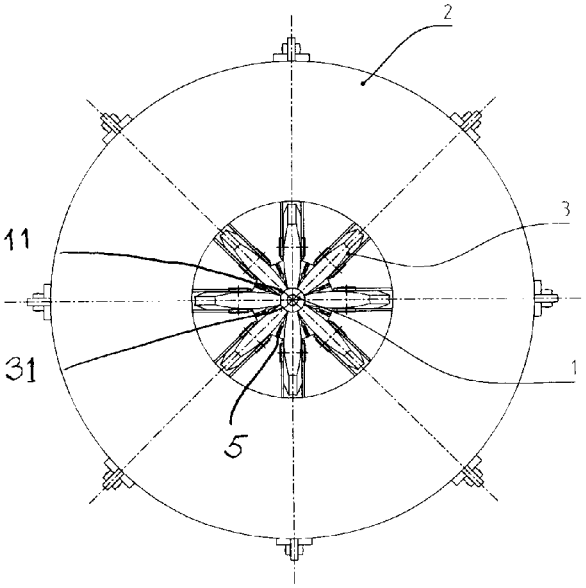
FIG. 7 is an end view of the device taken from a right side of FIG. 6.

FIG. 7 is an end view of the machine taken from the right side of FIG. 6. FIG. 7 shows how the radii of curvature of the cam roller surfaces 31 decrease as the radii of the surfaces 31 from the cam roller centers increase. FIG. 7 also shows the pipe wall 11 becoming thick and the forming surfaces of the cam rollers being pressed together at points of contact with the pipe 1. The segmental meshing gears 5 on sloping cam roller walls are also apparent.

Figure 8:
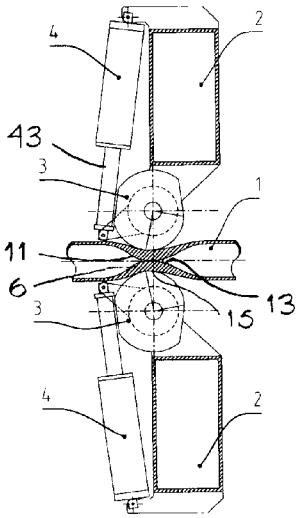
FIG. 8 shows how the hydraulic cylinders, piston rods, levers and cam rollers continue pressing inward, closing the pipe and making the pipe into a solid rod.

FIG. 8 shows the hydraulic cylinders 4 extending the piston rods 43 to turn the levers 38 and rotate cam rollers 3 to continue pressing outer surface 15 of the pipe wall 11 inward, closing the inner diameter 13 of pipe 1 and making the pipe into a solid rod 6. Finally this section of the pipe becomes a solid rod 6 instead of a pipe having a lumen.

Figure 9:
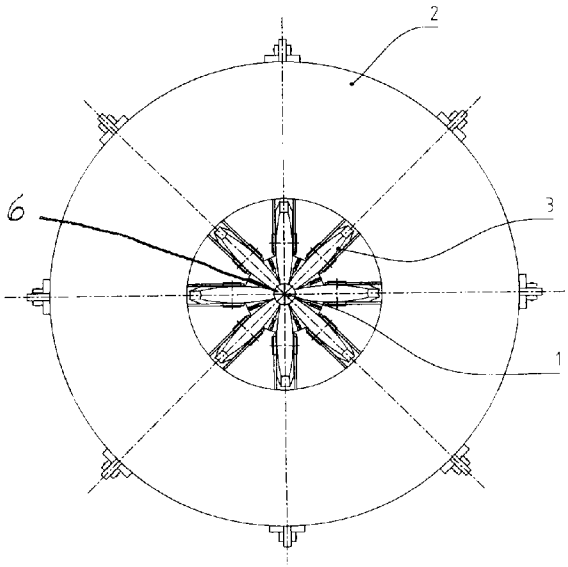
FIG. 9 is an end view of the device taken from the right side of FIG. 8.

FIG. 9 is an end view of the device taken from the right side of FIG. 8 showing the strong frame 2 and the pipe 1 compressed into a solid rod 6 by the cam rollers 3.

Figure 10:
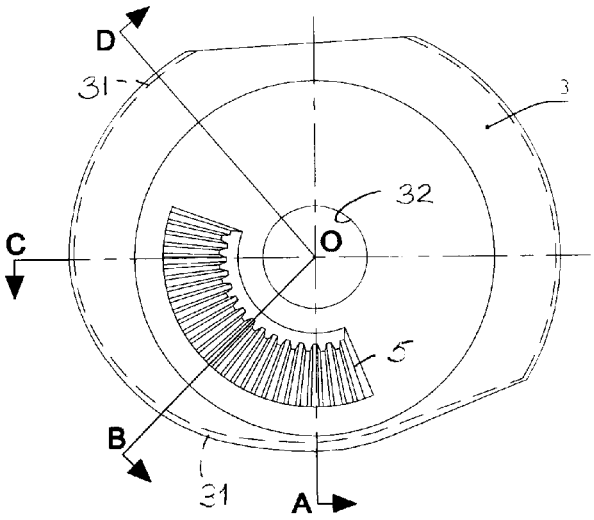
FIG. 10 is a cam roller side view that shows the central hole for the axle, a bevel gear sections on the cam roller conical face and the perimeter curvature of the roller cam pipe contacting surface.

FIG. 10 shows a side of cam roller 3 and the central hole 32 for the axle 23. A bevel gear section 5 is on a conical face 51 of the roller cam 3. The perimeter curvature surface 31 of the roller cam 3 is shown in dashed lines. A, B, C and D locations show increasing radii from hole 32, while the radii of cam roller surface 31 curvature decreases to decrease to outer diameter 15 of the pipe 1.

Figure 11:
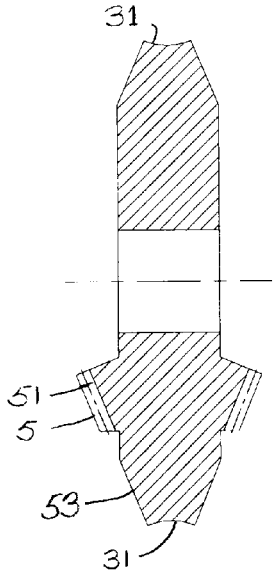
FIG. 11 is a cross section taken along lines B-D of FIG. 10 showing the bevel gear sections on opposite conical faces of the cam roller.

FIG. 11 is a cross section taken along lines B-D of FIG. 10 showing the bevel gear sections 5 on opposite conical faces 51 of the cam roller 3. The conical faces 53 near the pipe contacting surface 31 have the same slope as faces 51. The faces 51 and 53 of adjacent cam rollers 3 are pressed together as the pistons 43 and lever arms 38 continue to press the cam rollers 3 inward, and the cam rollers rotate around the axles 23 shown in FIG. 1. That ensures that the pipe contacting surfaces 31 of all cam rollers are contiguous.

Figure 12:
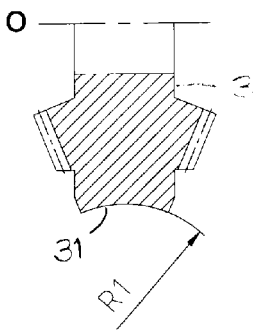
FIGS. 12-14 are different cross sections taken along lines OA, OB and OC of FIG. 10 of a cam roller to show how the surface track of a roller cam external perimeter changes to reduce radii of cam roller surfaces at increased distances from axle holes for always producing a circular compression of a pipe to form a nozzle, joint or rod.
Figure 13:
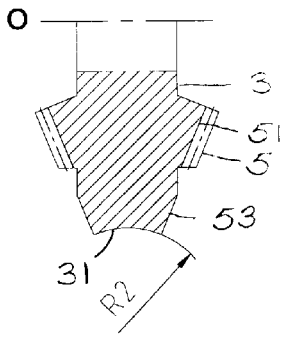
Figure 14:
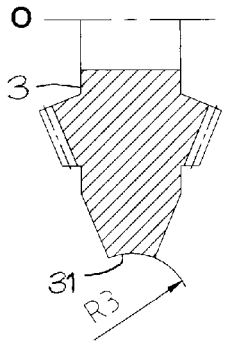

FIGS. 12-14 are different cross sections taken along lines OA, OB and OC of FIG. 10 of a cam roller 3 to show how the external surface track of a cam roller 3 external perimeter changes to reduce diameters of cam roller surfaces at increased distances from axle holes for always producing a circular compression for a nozzle, joint or rod.

Figure 15:
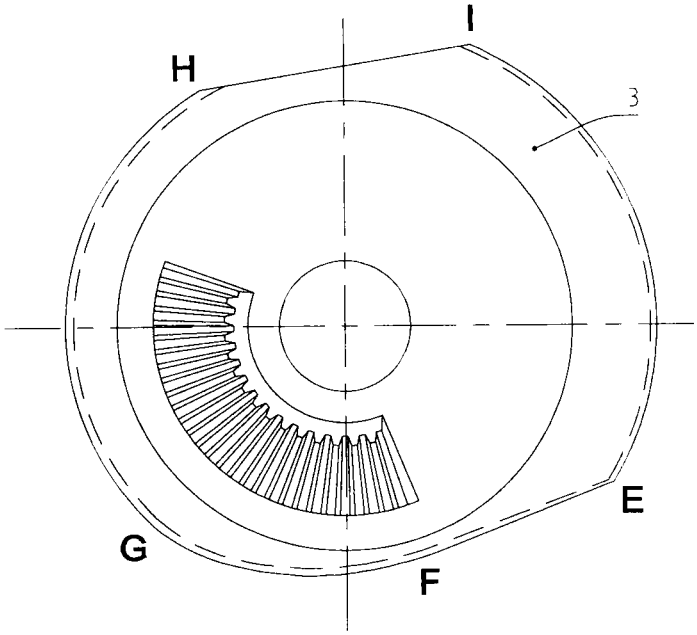
FIG. 15 is a side view of a roller cam showing a cam roller surface structure.

FIG. 15 is a side view of a roller cam 3 showing a cam roller structure.

Making a nozzle or a joint uses the machine described in FIGS. 1 to 15, but with a different curvature in the external perimeter of the cam rollers, to obtain a cylindrical joint. The perimeter curvature is shown in the FIG. 15. Between the point E and F is a straight line. From the point F to G will be spiral curve, this is to say, the distance from the center O to the extended contact point will be increasing when the cam rollers 3 rotate. From the points G to H, the distance will be constant, so the curve is a circular sector. To obtain a sealed joint, it is necessary to press the exterior pipe until the steel material of both pipes moves the pipe inward beyond the yield point. The outer pipe is moved inward beyond the yield point. At the same time the inner pipe is moved inward a distance before its yield point. Then when the external force is removed, the two pipes will be making forces one against the other. That will make a strong joint.

In an example, the cylinders provide 160 tons of force. The lever arms and cam rollers multiply that force to a more than 1,000 tons of force against the pipe. Eight inches of movement of the piston rods provides one inch of inward movement of the cam rollers against the pipe wall in the example.

While the invention has been described with reference to specific embodiments, modifications and variations of the invention may be constructed without departing from the scope of the invention, which is defined in the following claims.

I claim:

1. A method comprising changing diameter of a pipe to form a nozzle, joint, enlargement or solid rod by rotating cam rollers with concave curved cammed peripheral pipe contacting surfaces having decreased widths and increased radii on a surface of the pipe and forcing the surface and a wall of the pipe to move radially with outer surfaces of the cam rollers while turning the cam rollers, providing a frame, connecting axles to the frame and mounting the rollers on the axles, providing hydraulic cylinders, connecting outer ends of the hydraulic cylinders to the frame and connecting inner ends to cam rollers for rotating and turning the cam rollers.

2. The method of claim 1, further comprising changing the widths and the radii of curvature of outer pipe contacting surfaces concurrently with changing radial distances of the pipe contacting surfaces from centers of the cam rollers.

3. The method of claim 1, wherein the cam rollers have lateral side surfaces adjacent the concave curved cammed peripheral pipe contacting surfaces which are always in contact with the lateral side surfaces of adjacent cam rollers.

4. The method of claim 1, further comprising providing meshing bevel gears on sloping side surfaces of the cam rollers and forcing uniform rotation of the cam rollers with the bevel gears.

5. A method comprising changing diameter of a pipe to form a nozzle, joint, enlargement or solid rod by rotating cam rollers with curved pipe contacting surfaces on a surface of the pipe and forcing the surface and a wall of the pipe to move radially with outer surfaces of the cam rollers while turning the cam rollers, further comprising changing widths and radii of curvature of outer pipe contacting surfaces concurrently with changing radial distances of the pipe contacting surfaces from centers of the cam rollers, further comprising surrounding the pipe with a rigid frame, attaching outer ends of cylinders to the frame, connecting ends of pistons from the cylinders to lever arms, connecting the lever arms to the cam rollers, providing axles fixed on inner ends of the frame, mounting the cam rollers on the axles, applying hydraulic pressure in the cylinders, forcing the pistons inward, rotating the lever arms with the pistons, rotating the cam rollers with the lever arms, moving the pipe contacting surfaces inward on the pipe, moving a wall of the pipe inward with the pipe contacting surfaces, reducing diameters of outer and inner surfaces of the pipe, and increasing thickness of a wall of the pipe.

6. The method of claim 5, further comprising connecting two lever arms to each cam roller, one lever arm on either side of each cam roller.

7. The method of claim 6, wherein the rotating of the cam rollers comprises rotating the cam rollers in planes radiating from the longitudinal axis of the pipe.

8. The method of claim 5, wherein the providing the axles comprises fixing the axles in planes perpendicular to a longitudinal axis of the pipe.

9. The method of claim 5, further comprising providing the cam rollers with sloping side surfaces and maintaining contiguity of the outer pipe contacting surfaces while rotating the cam rollers.

10. The method of claim 5, further comprising providing meshing bevel gears on the sloping side surfaces of the cam rollers and forcing uniform rotation of the cam rollers with the bevel gears.

11. The method of claim 5, further comprising fixing the pipe against movement while rotating the cam rollers and forcing the surface and a wall of the pipe to move radially.

12. The method of claim 5, further comprising moving the pipe axially in a direction of the cam rollers while rotating the cam rollers and forcing the surface and a wall of the pipe to move radially.

13. Apparatus comprising a frame, plural cylinders having ends connected to the frame, pistons mounted in the cylinders, axles connected to the frames, cam rollers mounted on the axles, lever arms connected to the cam rollers and connected to the pistons, the cam rollers having outer peripheral pipe contacting surfaces of varied distance from the axles, the pipe contacting surfaces having concave surfaces of varied radii of curvature, the radii of curvature decreasing as the distance from the axles increases, the cam rollers having sloped side walls of decreasing width between the side walls as the distance from the axles increases, whereby increasing pressure in the cylinders moves the pistons which rotate the lever arms and the cam rollers and increase the distance of the pipe contacting surfaces from the axles and decreases the radii of curvature of the pipe contacting surfaces and forces a wall of a pipe inward, decreasing diameters of inner and outer surfaces of the pipe and increasing wall thickness of the pipe.

14. The apparatus of claim 13, wherein the frame is a rigid box frame, further comprising a lateral outward extension on the rigid box frame, wherein the ends of the cylinders are connected to the lateral outward extensions.

15. The apparatus of claim 14, further comprising inward extensions on the box frame, wherein the axles are mounted on the inward extensions.

16. The apparatus of claim 13, wherein two lever arms are connected to each cam roller, one lever arm on either side of each cam roller.

17. The apparatus of claim 13, wherein the axles are fixed in planes perpendicular to a longitudinal axis of the pipe.

18. The apparatus of claim 17, wherein the cam rollers rotate in planes radiating from the longitudinal axis of the pipe.

19. The apparatus of claim 13, wherein the cam rollers have inward sloping sides and provide contiguity to the pipe contacting surfaces.

20. The apparatus of claim 19, further comprising meshing bevel gears on the sloping sides of the cam rollers, forcing the cam rollers to rotate together.

* * * * *